US006899286B2

(12) United States Patent
Blessing

(10) Patent No.: US 6,899,286 B2
(45) Date of Patent: May 31, 2005

(54) SHOWER HEAD

(75) Inventor: Gerd Blessing, Obereschach (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 10/203,460

(22) PCT Filed: Feb. 9, 2001

(86) PCT No.: PCT/EP01/01440

§ 371 (c)(1),
(2), (4) Date: Nov. 20, 2002

(87) PCT Pub. No.: WO01/58597

PCT Pub. Date: Aug. 16, 2001

(65) Prior Publication Data

US 2003/0098366 A1 May 29, 2003

(30) Foreign Application Priority Data

Feb. 9, 2000 (DE) ..... 100 05 686

(51) Int. Cl.[7] ..... B05B 3/00
(52) U.S. Cl. ..... 239/225.1; 239/380; 239/236
(58) Field of Search ..... 299/380, 381, 299/382, 383, 390, 394, 396, 463, 483, 487, 493; 239/380, 381, 382, 383, 390, 394, 396, 463, 483, 487, 493, 225.1, 236

(56) References Cited

U.S. PATENT DOCUMENTS 5,598,975 A * 2/1997 Jager ..... 239/237
5,704,547 A 1/1998 Golan et al. ..... 239/11
6,155,494 A 12/2000 Fabbri et al. ..... 239/240
6,196,475 B1 3/2001 Jaeger ..... 239/381

FOREIGN PATENT DOCUMENTS

| | | |
|---|---|---|
| DE | G8801793 | 5/1988 |
| DE | 3915962 | 9/1990 |
| DE | 19735550 | 1/1998 |
| DE | 19821919 | 11/1999 |

OTHER PUBLICATIONS

Copy of International Search Report of Jun. 28, 2002.

Copy of German Search Report of Aug. 25, 2000.

* cited by examiner

*Primary Examiner*—Thomas Denion
*Assistant Examiner*—Zelalem Eshete
(74) *Attorney, Agent, or Firm*—Duane Morris LLP

(57) ABSTRACT

A shower head more particularly constructed as a lateral shower contains in its interior a turbine drivable by the flow of the water flowing into and out of it. During its rotary movement the turbine entrains a nozzle body, which engages with a spigot in a guide path. The water leaves the shower through a bore located in the nozzle body. As a result of the design of the guide path it is possible to continuously modify the direction in which the water jet passes out of the shower head.

8 Claims, 1 Drawing Sheet

SHOWER HEAD

SHOWER HEAD

Figure 1:
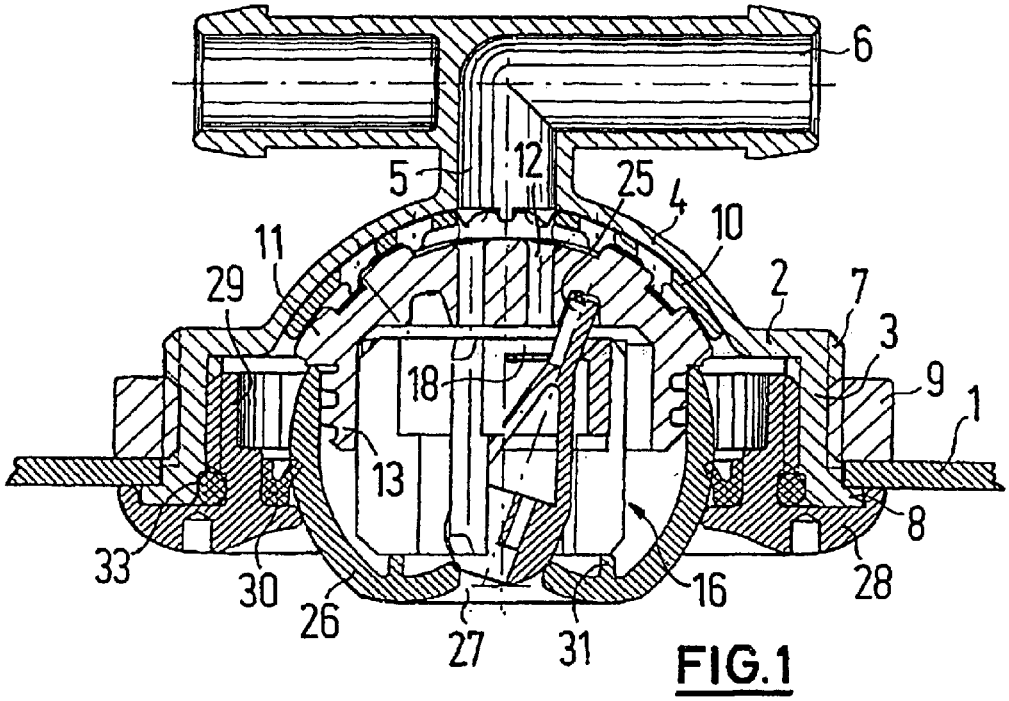

Showers head are used for creating a possibility of the water used for showering being discharged at a specific point and/or in a specific manner. There are numerous types of different shower heads. An attempt is frequently made to give special characteristics to the exiting water jets so as to bring about an improved or more pleasant showering action, or in order to merely optically modify the appearance. Thus, massaging jets, pulsating jets, jets in which the jet pattern can be adjusted or automatically modified, etc. are known.

The problem of the invention is to provide a shower head in which the jet pattern can be modified in a hitherto unknown manner.

This problem is resolved according to the present invention as defined in the independent claims. Further developments of the invention form the subject matter of the dependent claims, whose wording like that of the abstract is by reference made into part of the content of the present description.

The water jet leaving the jet exit opening moves in a continuously changing direction. On striking the body of the showering person, it consequently describes a closed line, which gives rise to a certain massaging action. In addition, the body of the showering person is sprayed with water over a larger area, although the shower head does not change position. As a function of the speed with which the direction changes, optically a pattern is obtained, which differs from the jet patterns of conventional showers.

According to a further development of the invention, the device for continuously modifying the direction of the exiting jet with respect to the casing can be driven by the water flowing into and out of the shower head. No additional devices are required.

The invention more particularly proposes that the water jet is moved in such a way that it is located in the circumferential surface of a cone. It can advantageously be a cone diverging from a circular cone.

According to the invention, the apex of the cone is located roughly in the vicinity of the jet disk and optionally displaced somewhat into the interior of the shower head casing. This makes it possible on the one hand to create a very interesting jet pattern and on the other to bring about a small casing, because only a single, relatively small opening is required for the discharge of the jet.

The jet has a particularly surprising appearance if a cross-section through the cone also has concave portions.

For example, the jet direction change can be such that a cross-section through the cone is roughly in the form of a figure of eight.

To bring about the direction change of the exiting jet, according to the invention the jet passes through and out of a nozzle body, which can be mounted in mobile manner in the casing.

For moving the nozzle body and therefore for changing the jet direction, a rotating turbine can be located in the shower head casing and moves the nozzle body.

In order to produce a specific movement of the nozzle body, the latter can cooperate with a casing-fixed link or a cam or guide path. The nozzle body can e.g. be retained in the turbine in such a way that the turbine at least partly carries it in its rotary movement.

For example, the nozzle body can have a front, rounded section, in which it is pivotably and/or rotatably mounted in the jet exit opening.

According to the invention, in order to improve the jet pattern, the nozzle body can be positioned in such a way that the opening from which the water jet passes can be inwardly displaced with respect to the jet disk and/or the shower head casing. As a result the nozzle body is substantially invisible during the shower operation.

The shower head according to the invention is more particularly, but not exclusively, suitable as a fixed installed shower, e.g. as a lateral shower. The surface wetted by the water jet can be vertically oriented, i.e. the aforementioned figure of eight is vertically oriented. As a result, e.g. when superimposing two showers, it is possible to cover a larger part of the human body.

Further features, details and advantages of the invention can be gathered from the following description of a preferred embodiment thereof with reference to the attached drawings, wherein show:

FIG. 1 A section through an installed shower head according to the invention.

Figure 2:
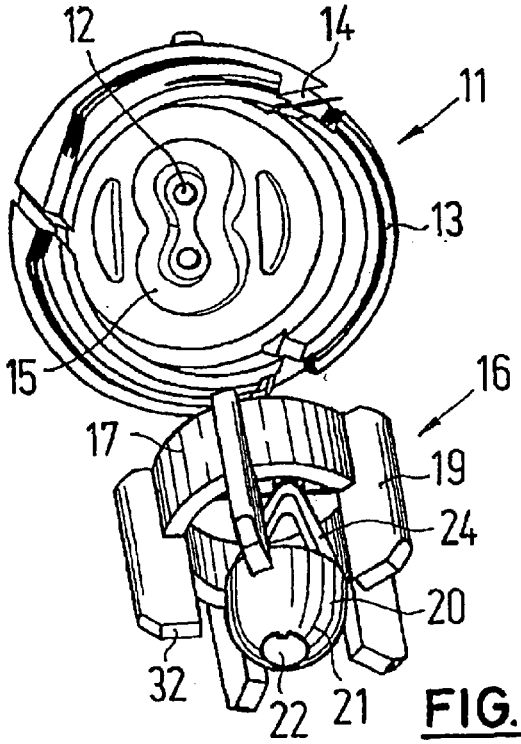

FIG. 2 Perspectively two components of the shower head of FIG. 1.

Figure 3:
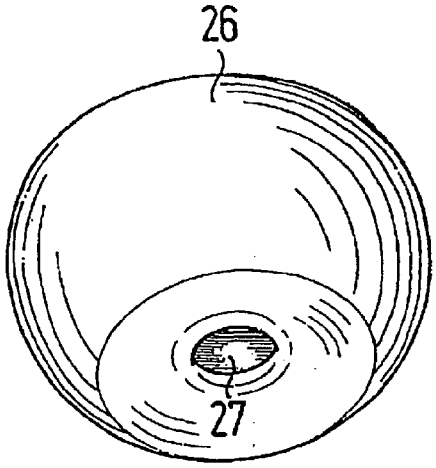

FIG. 3 Perspectively part of the shower head.

FIG. 1 shows in a longitudinal section the arrangement of a shower head according to the invention as a lateral shower. The lateral shower is installed in an opening of a plate 1, which can e.g. be the side wall of a shower cubicle. It is obviously also possible to install the lateral shower in the upper boundary of a shower cubicle in the form of a head shower. The shower head contains a rear casing part 2, which has a flat cylindrical section 3 with a part spherical extension 4. Roughly in the center of the part spherical extension 4 is provided an inlet connection 5, which is e.g. in one piece and passes into a pipe connection 6, where a water pipe can be fitted.

The flat cylindrical section 3 of the rear casing part 2 is provided on its outside with an external thread 7. In the vicinity of its front end the flat cylindrical section 3 has an outwardly directed flange 8. The rear casing part 2 is inserted from the front through the opening in the plate 1 until it engages with the flange 8 on the edge of the opening. Subsequently and from the rear a nut 9 is screwed onto the external thread 7, which then fixes the rear casing part 4 in the opening of the plate 1.

From the front or bottom is then inserted in said casing a part spherical distributor plate 10, which has individual openings for the passage of water. To it is connected a base part 11, which contains a rear, part spherical area with through openings 12 and a cylindrical skirt 13. This base part 11 is shown from below or from the front in FIG. 2. The skirt 13 contains at least one and preferably several inclined, radially directed slots 14 through which the water can flow in inclined manner into the interior of said skirt 13. Into said interior also issue the openings 12, which are shown in section in FIG. 1.

Around the openings 12, the base contains a cam path 15, which is roughly shaped as a figure-eight slot having the same width throughout the cam path 15.

Within the skirt 13 of the base 11 space is provided for a freely rotatable turbine 16, shown perspectively in FIG. 2. The turbine 16 contains a ring element 17, which is terminated in the interior of the casing by a base with a radial slot 18. The radial slot 18 is shown in section in FIG. 1 and is only intimated in FIG. 2.

To the ring 17 are fitted turbine blades 19, which pass radially to the axis of symmetry of the casing and axially in their other extension. The outside of the turbine blades 19 is located on a cylinder, whose circumference roughly corresponds to the internal circumference of the skirt 13.

In the turbine element 16 is retained a nozzle body 20, which is formed from a front, rounded section 21 with a through bore 22 and a rear guide section. The guide section contains two webs 24, which pass into a spigot 25 arranged symmetrically in the extension of the bore 22. The diameter of the spigot 25 corresponds to the width of the cam path 15. The dimensions of the nozzle body 20 are selected in such a way that it is located within the turbine element 16 and engages with the spigot 25 in the link 15.

In this position both the turbine element 16 and the nozzle body 20 are held by a cap 26, which externally surrounds the skirt 13 and has an opening 27 in its central part. The edge of the opening 27 is drawn inwards somewhat. On said edge engages the rounded, front part 21 of the nozzle body 20, cf. FIG. 1. FIG. 1 shows the nozzle body 20 to the right of its center line in section and to the left in projection.

The cap 26 is engaged onto the base 11 to such an extent that its edge rests on a shoulder. In this position the cap 26 is secured by a front panel 28. This front panel with a circumferential skirt 29 is screwed into an internal thread of the flat cylindrical section 3 of the rear casing part 2. A seal 33 is placed between the casing part 2 and front panel 28 for sealing purposes. A circumferential lip seal 30 is provided for sealing purposes between the cap 26 and the front panel.

The cap 26 has on its inside and surrounding the opening 27 a ring 31, which supports the front edge 32 of the turbine blades 19. Thus, the turbine element 16 is axially held within the casing.

The device proposed by the invention and shown in the drawings functions as follows. The water flows through the inlet connection 5 into the interior of the casing 1 and then through the different openings. The water penetrating through the inclined, radially positioned slots 14 strikes the turbine blades 19 and rotates the turbine. The nozzle body, as its spigot 25 is held in a radial slot 18, is entrained during this rotary movement. During the rotary movement, the orientation of the nozzle body 20 is determined by the engagement of the end of spigot 25 in the guide slot 15. The water passing out of the opening 22 describes a pattern which is geometrically similar to that of the guide slot 15. On striking a body the water jet describes a closed line and in the example shown this is roughly a figure eight. Although there is a change in the angular orientation of the opening 22, its absolute position scarcely changes, so that the water jet is located on the circumferential surface of a cone, which in the example shown is not a circular cone. As a result of the configuration of the guide slot 15, it is possible to implement different shapes of the cone and therefore the line along which the water jet strikes a surface.

In the represented embodiment the front section 21 of the nozzle body 20 engages on the edge of the opening 27. The nozzle body is a separate part with respect to the cap 26. It would also be possible to link the nozzle body by means of a film hinge or membrane with a jet disk in such a way that instead of the nozzle body resting on an opening, it could also participate in the movement of the guide paths 15 as a result of the deformation of the membrane.

What is claimed is:

1. A shower head having a casing, a nozzle body movably mounted in the casing, the nozzle body having a jet exit opening from which a water jet exits in a specific direction with respect to the nozzle body and with a device for continuously modifying the direction of the jet with respect to the casing by varying an orientation of the nozzle body, wherein the device for continuously modifying the direction of the jet comprises a guide slot in the casing, the guide slot receiving part of the nozzle body and determining a changing orientation of the nozzle body by guiding said part of the nozzle body along a path, wherein the direction of the water jet moves along a cone-shaped shell, and wherein the cone-shaped shell is not a circular cone.

2. The shower head according to claim 1, wherein the device for continuously modifying the direction of the water jet can be driven by the water flowing into the shower head.

3. The shower head according to claim 1, wherein the cone-shaped shell has an apex roughly in a vicinity of the nozzle body.

4. A shower head having a casing, a nozzle body movably mounted in the casing, the nozzle body having a jet exit opening from which a water jet exits in a specific direction with respect to the nozzle body and with a device for continuously modifying the direction of the jet with respect to the casing by varying an orientation of the nozzle body, wherein the device for continuously modifying the direction of the jet comprises a guide slot in the casing, the guide slot receiving part of the nozzle body and determining a changing orientation of the nozzle body by guiding said part of the nozzle body along a path, wherein the direction of the water jet moves along a cone-shaped shell, and wherein a cross-section through the cone-shaped shell has concave portions.

5. A shower head comprising a casing, a nozzle body, a jet exit opening from which a water jet exits in a specific direction with respect to the nozzle body and a device for continuously modifying the direction of the jet with respect to the casing, the jet passing out of the nozzle body and the nozzle body being movably mounted in the casing, wherein the nozzle body has a spigot guided in a guide slot determining a path of movement thereof, wherein the guide slot causes the nozzle body to follow a cone and a cross-section through the cone is roughly in the form of a figure eight.

6. The shower head according to claim 2, wherein the nozzle body can be moved by a revolving turbine.

7. The shower head according to claim 6, wherein the nozzle body is retained in the turbine in such a way that the nozzle body is caused by the turbine to follow said guide slot.

8. The shower head according to claim 1, wherein the nozzle body is slightly inwardly displaced from a front of the casing.

* * * * *